US010295940B2

(12) United States Patent
Okanemasa

(10) Patent No.: US 10,295,940 B2
(45) Date of Patent: May 21, 2019

(54) BELT UNIT AND IMAGE HEATING APPARATUS HAVING A BELT UNIT THAT INCLUDES AN INSULATING HOLDER PORTION THAT PROVIDES INSULATION BETWEEN AN EXPOSED PORTION OF A LEAF SPRING AND A STAY

(71) Applicant: CANON KABUSHIKI KAISHA, Tokyo (JP)

(72) Inventor: Tempei Okanemasa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/007,144

(22) Filed: Jun. 13, 2018

(65) Prior Publication Data

US 2018/0364623 A1 Dec. 20, 2018

(30) Foreign Application Priority Data

Jun. 14, 2017 (JP) ..... 2017-116742
Apr. 26, 2018 (JP) ..... 2018-084972

(51) Int. Cl.
*G03G 15/20* (2006.01)

(52) U.S. Cl.
CPC ..... *G03G 15/2039* (2013.01); *G03G 15/2053* (2013.01); *G03G 15/2042* (2013.01); *G03G 2215/2019* (2013.01); *G03G 2215/2035* (2013.01)

(58) Field of Classification Search
CPC ..... G03G 15/2039; G03G 15/2053
USPC ..... 399/69
See application file for complete search history.

(56) References Cited

U.S. PATENT DOCUMENTS

| | | | | |
|---|---|---|---|---|
| 9,037,057 | B2 | 5/2015 | Suzuki et al. | |
| 9,316,975 | B2 | 4/2016 | Suzuki et al. | |
| 2011/0058862 | A1* | 3/2011 | Yamaguchi | G03G 15/2039 399/329 |
| 2016/0161891 | A1* | 6/2016 | Tanto | G03G 15/55 399/33 |
| 2018/0059588 | A1 | 3/2018 | Okanemasa | |

FOREIGN PATENT DOCUMENTS

JP 2012-252061 A 12/2012

* cited by examiner

*Primary Examiner* — Quana Grainger
(74) *Attorney, Agent, or Firm* — Venable LLP

(57) ABSTRACT

A belt unit includes an endless belt including a metal layer, a nip forming member having a heater that includes a heat generating element, a metal stay that presses the nip forming member toward a rotatable member, and a temperature detecting element. A metal leaf spring urges the temperature detecting element toward the inner peripheral surface of the endless belt, and an insulating supporting member is positioned inside the stay and supports the leaf spring. A cord electrically connects with the temperature detecting element through the leaf spring, and an insulating holder portion includes an interposed portion interposed between an exposed portion of the leaf spring and the stay, so as to provide insulation therebetween, and to hold the supporting member. A creepage distance from the heat generating element to the exposed portion of the leaf spring, through the stay and the interposed portion, is 2.5 mm or more.

16 Claims, 12 Drawing Sheets

BELT UNIT AND IMAGE HEATING APPARATUS HAVING A BELT UNIT THAT INCLUDES AN INSULATING HOLDER PORTION THAT PROVIDES INSULATION BETWEEN AN EXPOSED PORTION OF A LEAF SPRING AND A STAY

This application claims the benefit of Japanese Patent Application No. 2017-116742, filed on Jun. 14, 2017, and No. 2018-084972, filed on Apr. 26, 2018, which are hereby incorporated by reference herein in their entireties.

FIELD OF THE INVENTION AND RELATED ART

The present invention relates to a belt unit and an image heating apparatus, including the belt unit, suitably used as a fixing device mounted in an image forming apparatus, such as a copying machine, a printer, a facsimile machine, and a multi-function machine having a plurality of functions of these machines.

Electronic equipment represented by office automation (OA) equipment, such as the copying machine, household electrical appliance equipment, audio equipment, or the like, includes various electrical components.

As a fixing device (image heating apparatus) for use with an image forming apparatus of an electrophotographic type, a fixing device of a film heating type, as disclosed in, e.g., Japanese Laid-Open Patent Application No. 2012-252061 will be described as an example. This fixing device includes a cylindrical fixing film (cylindrical member), a heater (or a halogen lamp) provided inside the fixing film, a pressing pad slidable on an inner peripheral surface of the fixing film, and a pressing (urging) roller for sandwiching the fixing film between itself and the pressing pad.

Even in such a fixing device, for example, a temperature sensor for controlling the heater, direct current (DC) lines connected with the temperature sensor and the heater, and the like, are used as the electrical components. In a case in which these components parts are provided inside the fixing film, which is the cylindrical member, an inside space is narrow, and, therefore, there is a liability that metal components contact the temperature sensor, the DC lines, and the like. Further, it is concerned that a component disposed close to the fixing film contacts the fixing film during assembling and breaks.

Japanese Laid-Open Patent Application No. 2012-252061 discloses a constitution in which an interposed portion is provided between the fixing film and at least a part of the temperature sensor, the DC lines, and the like, in order to prevent contact of the temperature sensor and the DC lines with the fixing film.

Japanese Laid-Open Patent Application No. 2012-252061 has a problem, however, as described below.

Even in a case in which the DC line and a metal portion (secondary circuit) connecting with the DC line do not directly contact the heater (primary circuit), when the DC line and the metal portion connecting with the DC line cannot ensure spatial and creepage distances therefrom to the heater, it is concerned that a current supplied to the heater increases. Particularly, in a case in which a diameter of the fixing film (endless belt) is small, it is difficult to ensure a large gap (spacing) between components.

Specifically, the spatial distance between a metal stay and an exposed portion of a leaf spring for urging a temperature detecting element contacting an inner surface of the fixing film (endless belt) is small, and, therefore, the creepage distance between the metal stay and the exposed portion of the leaf spring cannot be ensured, so that there is a liability that the current supplied to the heater increases.

SUMMARY OF THE INVENTION

A principal object of the present invention is to provide a belt unit and an image heating apparatus that are capable of suppressing an increase in current supplied to a heater caused by an insufficient creepage distance between the heater and a leaf spring for urging a temperature detecting element contacting an inner surface of an endless belt.

According to one aspect, the present invention provides a belt unit for forming a heating nip in cooperation with an opposing rotatable member, the belt unit comprising an endless belt including a metal layer, a heater including a heat generating element generating heat by energization and configured to heat the endless belt in contact with an inner peripheral surface of the endless belt, a nip forming member including the heater and configured to sandwich the endless belt in cooperation with the rotatable member so as to form the heating nip, a metal stay configured to press the nip forming member toward the rotatable member, a temperature detecting element, a metal leaf spring configured to urge the temperature detecting element toward the inner peripheral surface of the endless belt, an insulating supporting member positioned inside the stay and configured to support the leaf spring, a cord configured to electrically connect with the temperature detecting element through the leaf spring, and an insulating holder portion including an interposed portion interposed between an exposed portion of the leaf spring and the stay so as to provide insulation therebetween and configured to hold the supporting member.

According to another aspect, the present invention provides an image heating apparatus comprising an endless belt including a metal layer, a rotatable member configured to form a heating nip, in which a toner image on a sheet is heated, in cooperation with the endless belt, a heater including a heat generating element generating heat by energization and configured to heat the endless belt in contact with an inner peripheral surface of the endless belt, a nip forming member including the heater and configured to sandwich the endless belt in cooperation with the rotatable member so as to form the heating nip, a metal stay configured to press the nip forming member toward the rotatable member, a temperature detecting element, a metal leaf spring configured to urge the temperature detecting element toward the inner peripheral surface of the endless belt, an insulating supporting member positioned inside the stay and configured to support the leaf spring, a cord configured to electrically connect with the temperature detecting element through the leaf spring, and an insulating holder portion including an interposed portion interposed between an exposed portion of the leaf spring and the stay so as to provide insulation therebetween and configured to hold the supporting member.

Further features of the present invention will become apparent from the following description of exemplary embodiments with reference to the attached drawings.

Figure 5:
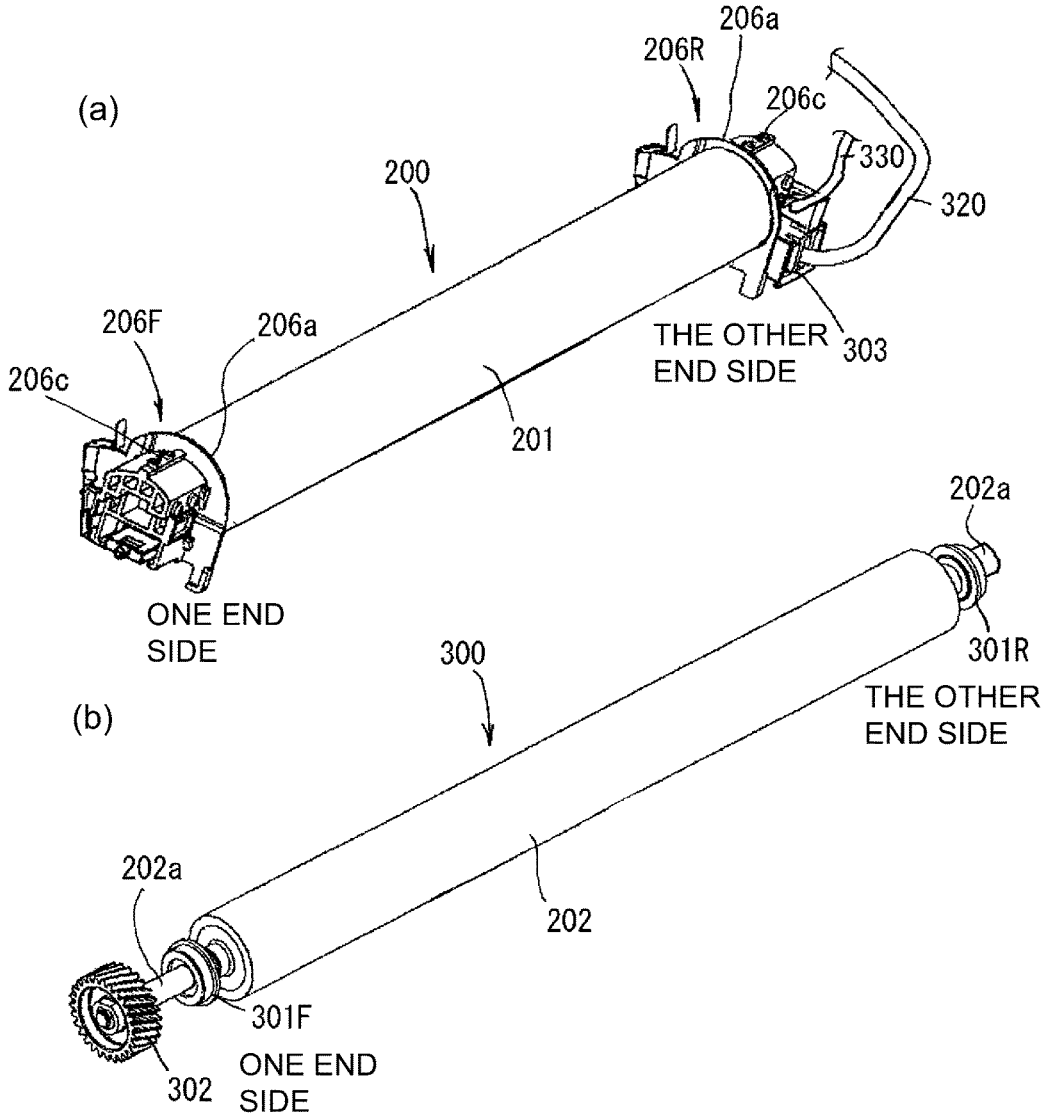

Part (a) of FIG. 5 is a perspective view of an outer appearance of the belt unit, and part (b) of FIG. 5 is a perspective view of an outer appearance of a pressing roller unit.

Figure 6:
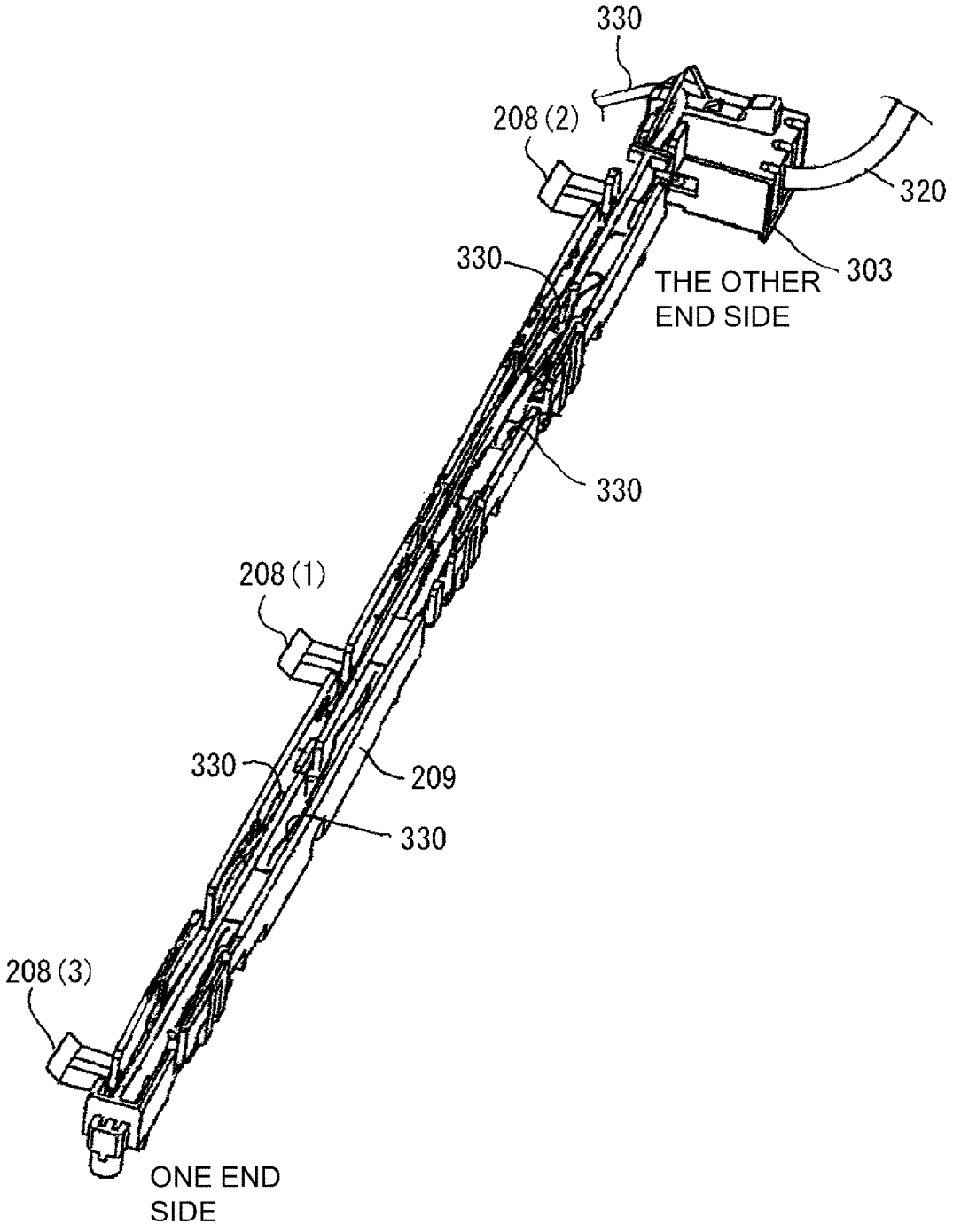

FIG. 6 is a perspective view of a thermistor holder on which a heater thermistor, a belt thermistor, a thermo switch, DC lines, and the like, are assembled and supported, as seen from a side opposite to a heater side.

Figure 7:
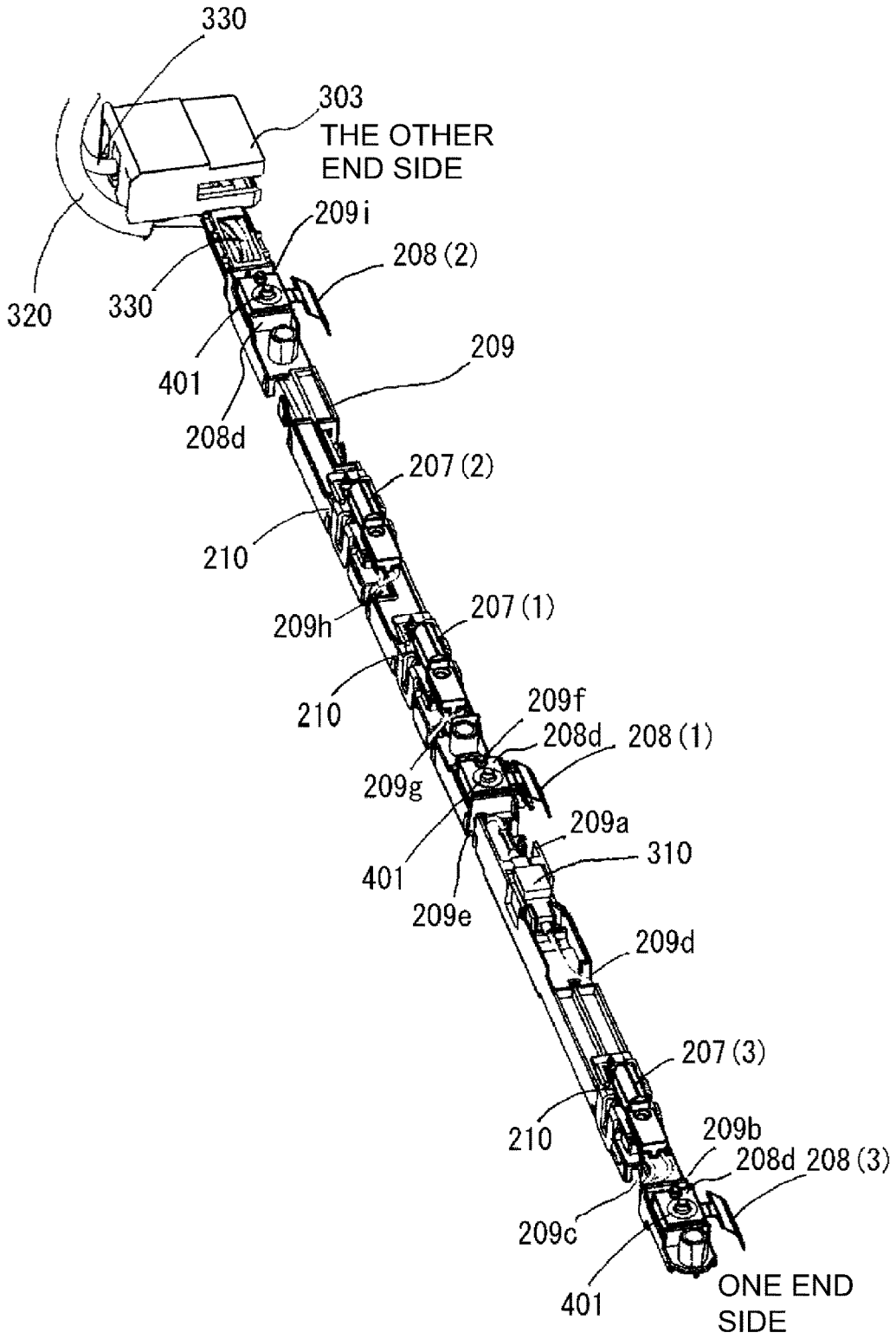

FIG. 7 is a perspective view of the thermistor holder as seen from the heater surface (a side facing a back surface of a heater).

Figure 8:
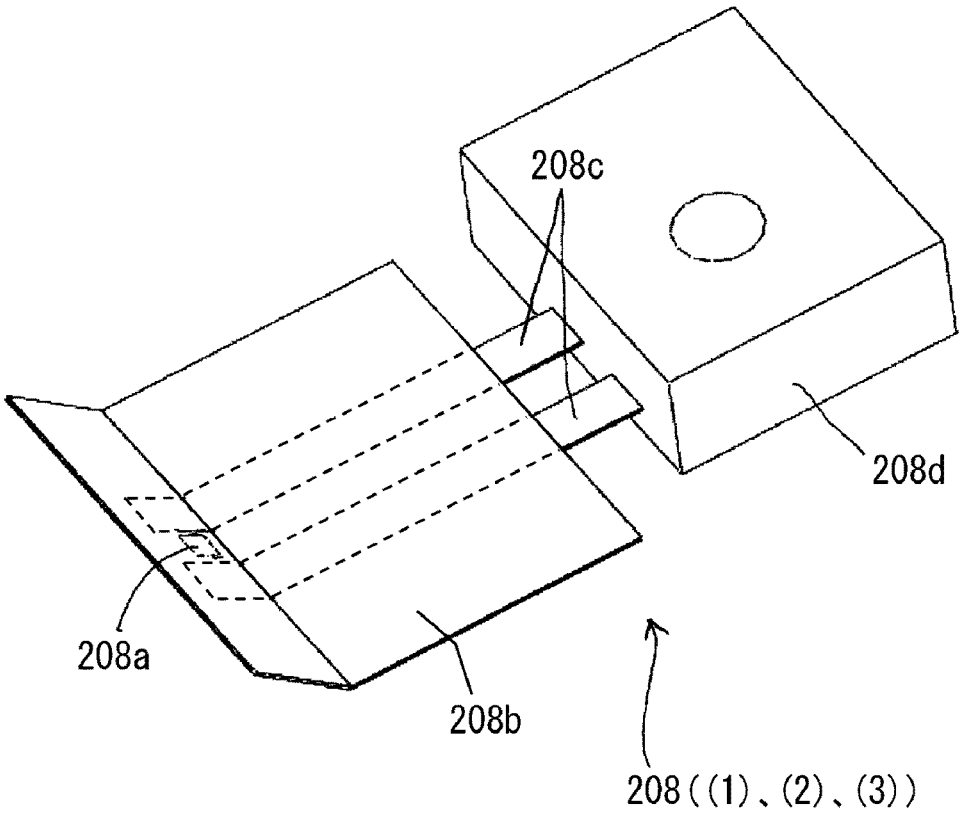

FIG. 8 is an enlarged perspective view of the belt thermistor.

Figure 9:
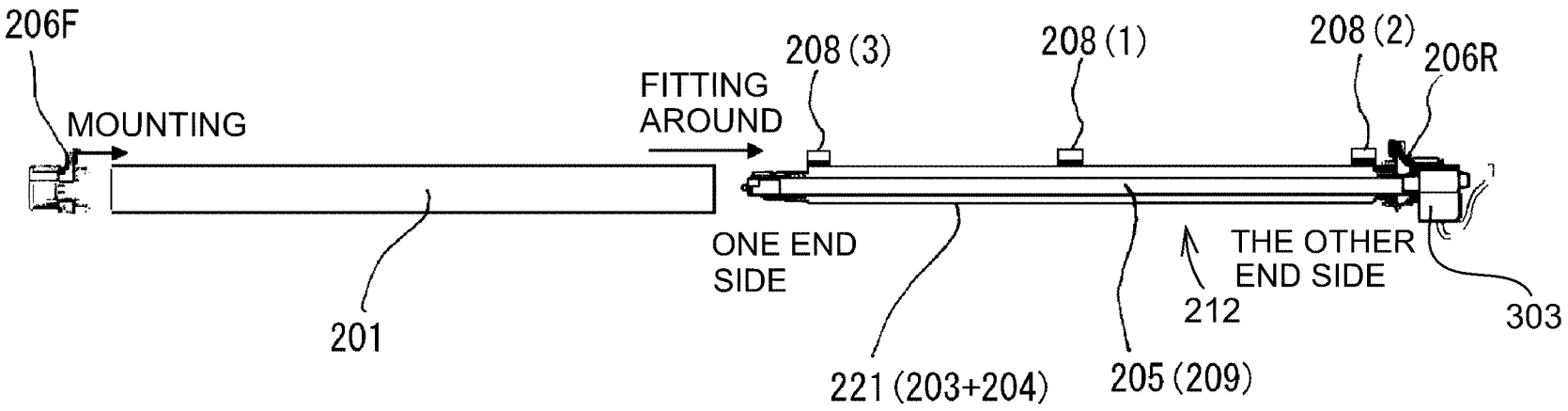

FIG. 9 is a schematic view for illustrating an example of a belt assembling method.

Figure 10:
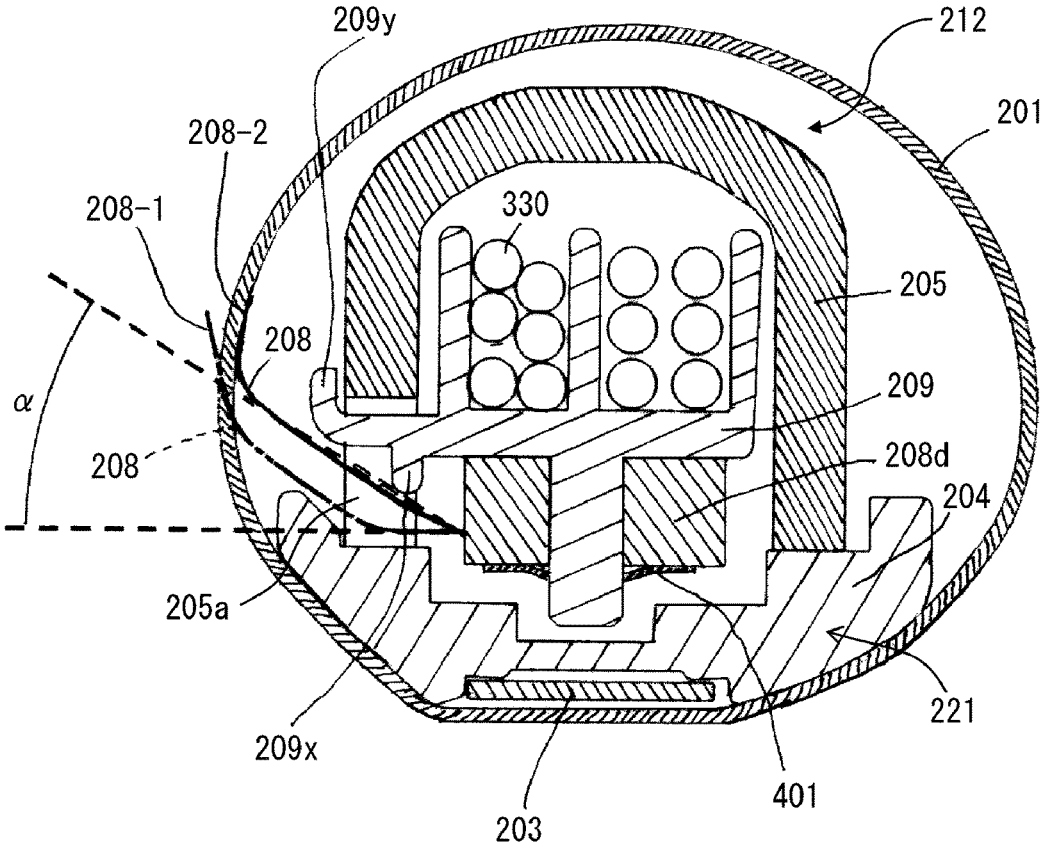

FIG. 10 is a schematic view for illustrating an elastically deformed region of the belt thermistor.

Figure 11:
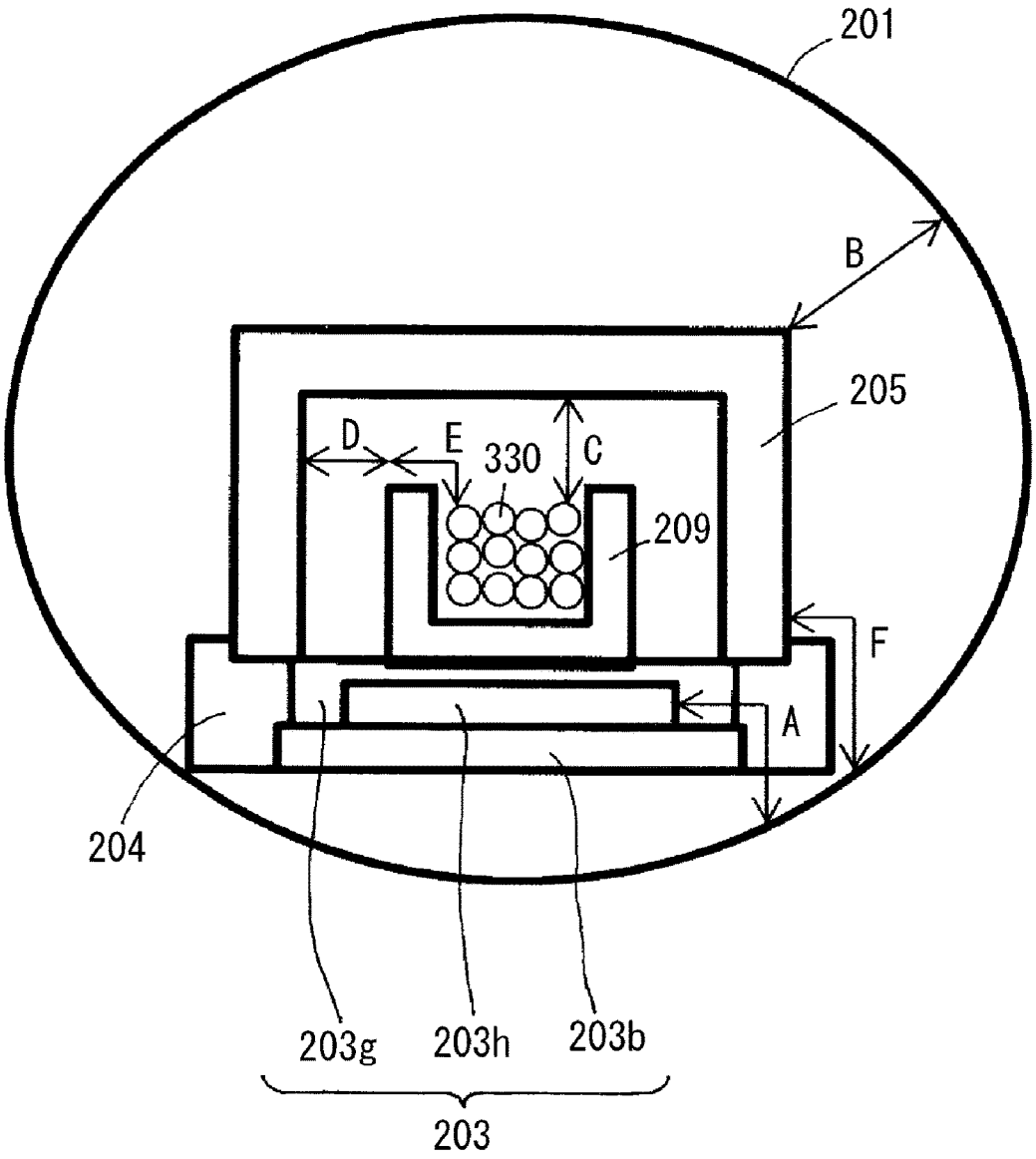

FIG. 11 is a schematic view for illustrating an insulating structure.

Figure 12:
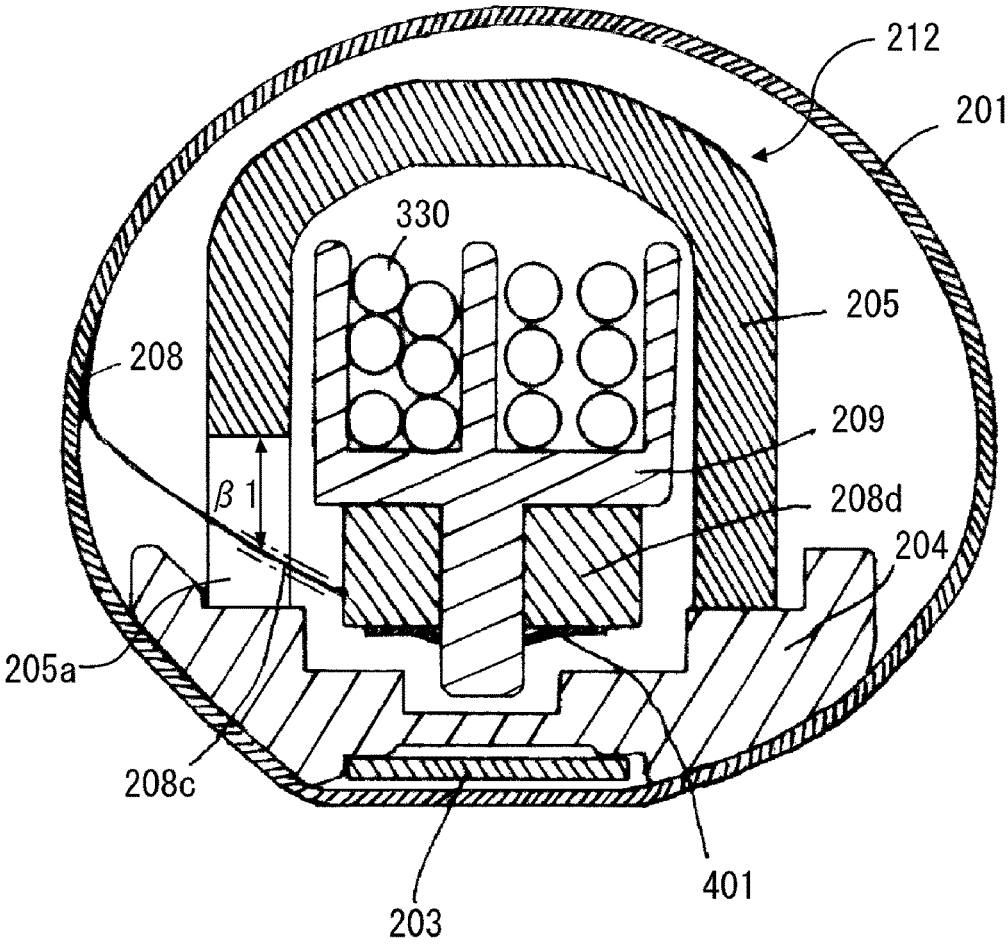

FIG. 12 is a schematic view for illustrating a creepage distance between a metal stay and a leaf spring portion (metal portion) of the belt thermistor in a case in which an interposed portion is not provided in the thermistor holder.

DESCRIPTION OF EMBODIMENTS

Embodiments of the present invention will be specifically described with reference to the drawings.

Embodiment (1) Image Forming Apparatus

Figure 2:
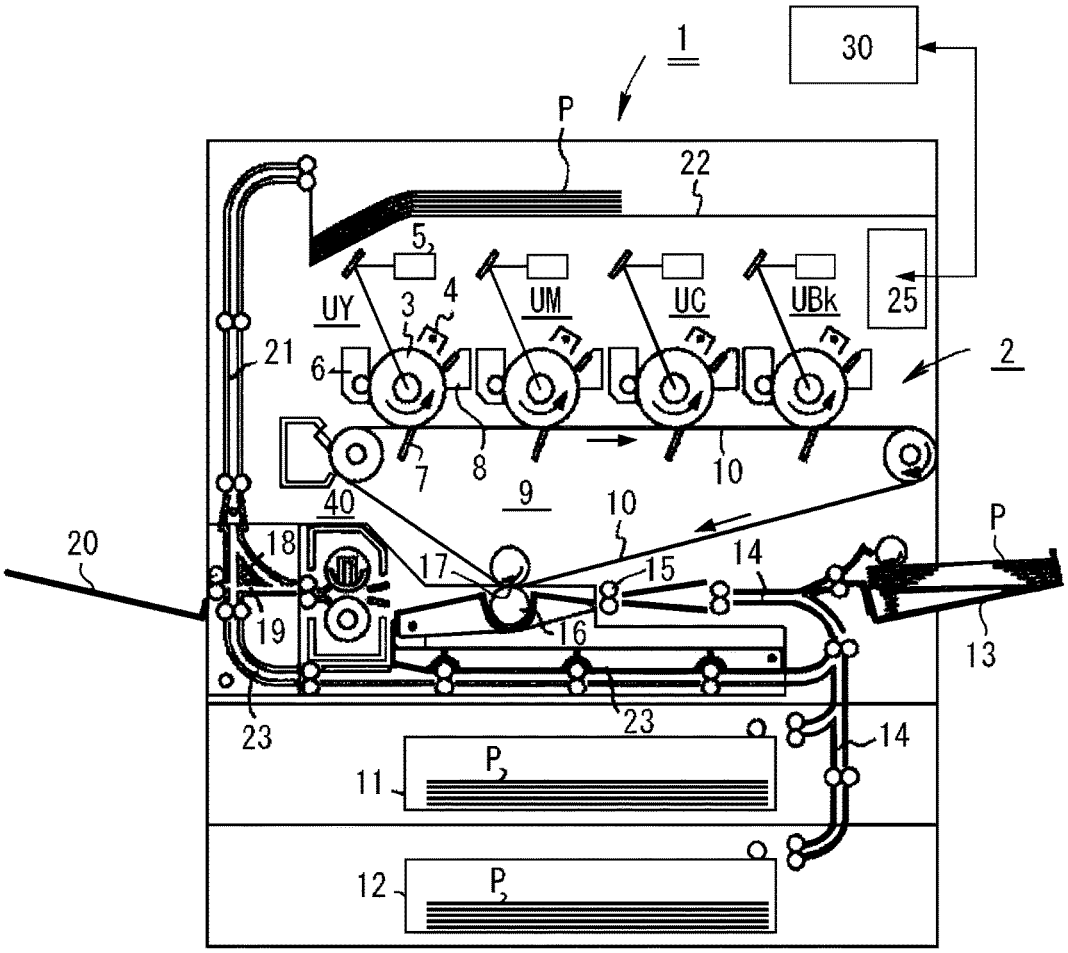
FIG. 2 is a schematic sectional view of an image forming apparatus in the embodiment.

FIG. 2 is a schematic sectional view of an example of an image forming apparatus 1 in an embodiment. This is image forming apparatus 1 is a four-color-based full-color printer of a tandem type and an intermediary transfer type, using an electrophotographic process. This printer 1 performs an image forming operation on the basis of image information (i.e., an image signal) input from an external terminal 30, such as a personal computer, to a controller (main assembly controller, or central processing unit (CPU)) 25, and is capable of forming a toner image on a recording material (sheet) P and printing out the toner image.

The recording material P is a sheet-like recording medium capable of permitting formation of the toner image thereon by the printer (image forming apparatus) 1, and, as a specific example, it is possible to use plain paper having a basis weight of 60 g/m$^2$ to 105 g/m$^2$, thick paper having a basis weight of exceeding 106 g/m$^2$, a resin sheet, and the like.

In the printer 1, an image forming portion 2 for forming toner images on the recording materials P includes four image forming units U (Y, M, C and Bk) for forming the toner images of Y (yellow), M (magenta), C (cyan), and Bk (black), respectively. The image forming portion 2 further includes an intermediary transfer belt unit. Each of the image forming units U includes an electrophotographic photosensitive drum 3 to be rotationally driven, and electrophotographic process devices actable on the drum 3, such as a charging device 4, a laser scanner 5, a developing device 6, a primary transfer charging device 7, and a drum cleaner 8.

Incidentally, in order to minimize the complexity of FIG. 2, reference numerals for representing the devices of the image forming units UM, UC, and UK, i.e., those image forming units other than the image forming unit UY, are omitted from illustration in FIG. 2. Further, an electrophotographic process and the image forming operation of the image forming portion 2 are well known, and, therefore, will be omitted from description.

The color toner images are primary-transferred superposedly from the drums 3 of the respective image forming units U onto an intermediary transfer belt 10. As a result, on the belt 10, the superposed toner images of the four colors of Y, M, C, and Bk are formed.

On the other hand, a single sheet of the recording material P is fed from a cassette 11 or 12, or from a manual feeding tray 13, and passes through a feeding path 14 including a registration roller pair 15, and is then introduced at predetermined control timing into a second transfer unit 17, which is a press-contact portion between the belt 10 and a second transfer roller 16. As a result, the superposed four color toner images are secondary-transferred altogether from the belt 10 onto the recording material P. Then, the recording material P is introduced into a fixing device (image heating apparatus) 40. By this fixing device 40, unfixed toner images on the recording material P are fixed as fixed images under application of heat and pressure.

The recording material P coming out of the fixing device 40 is guided to a feeding path 19 by a flapper 18 controlled by the controller in the case of an operation in a one-side printing mode, and is then discharged as a one-side image-formed product on a discharge tray 20 in a face-down state (in which an image surface faces downward). Alternatively, the recording material P is guided to a feeding path 21 and is then discharged on a discharge tray 22 in a face-up state (in which the image surface faces upward).

In the case of an operation in a double-side printing mode, the recording material P coming out of the fixing device 40 is once guided to the feeding path 21 side and is then fed in a switch-back manner and thus, is guided to a feeding path 23 for double-side printing. Then, the recording material P passes through the feeding path 14 again in an upside-down state and is then guided to the secondary transfer unit 17, so that the toner images are transferred onto the other surface of the recording material P. Thereafter, similarly as in the case of the operation in the one-side printing mode, the recording material P is guided to the fixing device 40, and is then discharged as a double-side image-formed product on the discharge tray 20 or 22.

(2) Fixing Device 40

Figure 3:
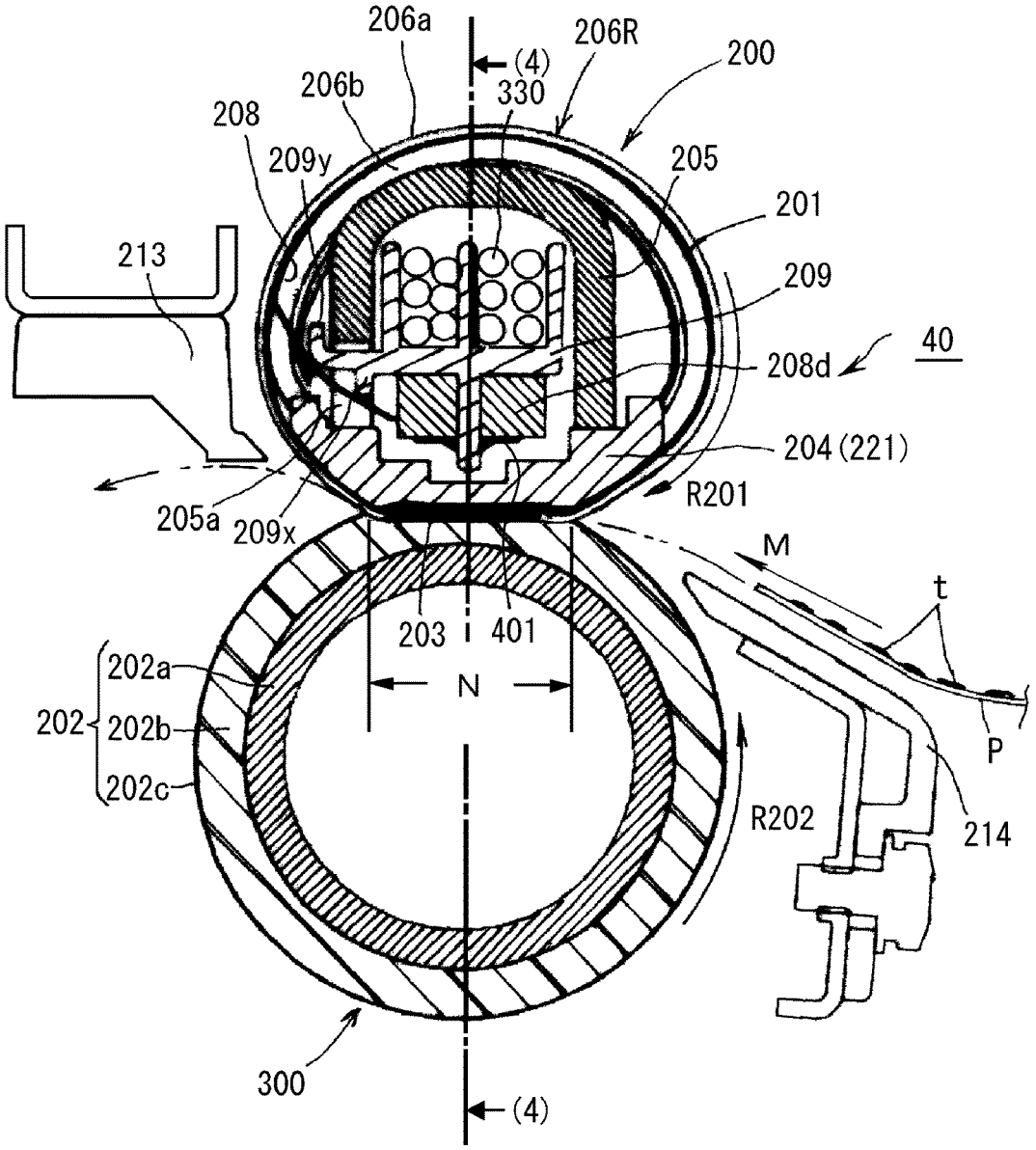
FIG. 3 is an enlarged schematic cross-sectional view of a principal part of the fixing device in the embodiment.
Figure 4:
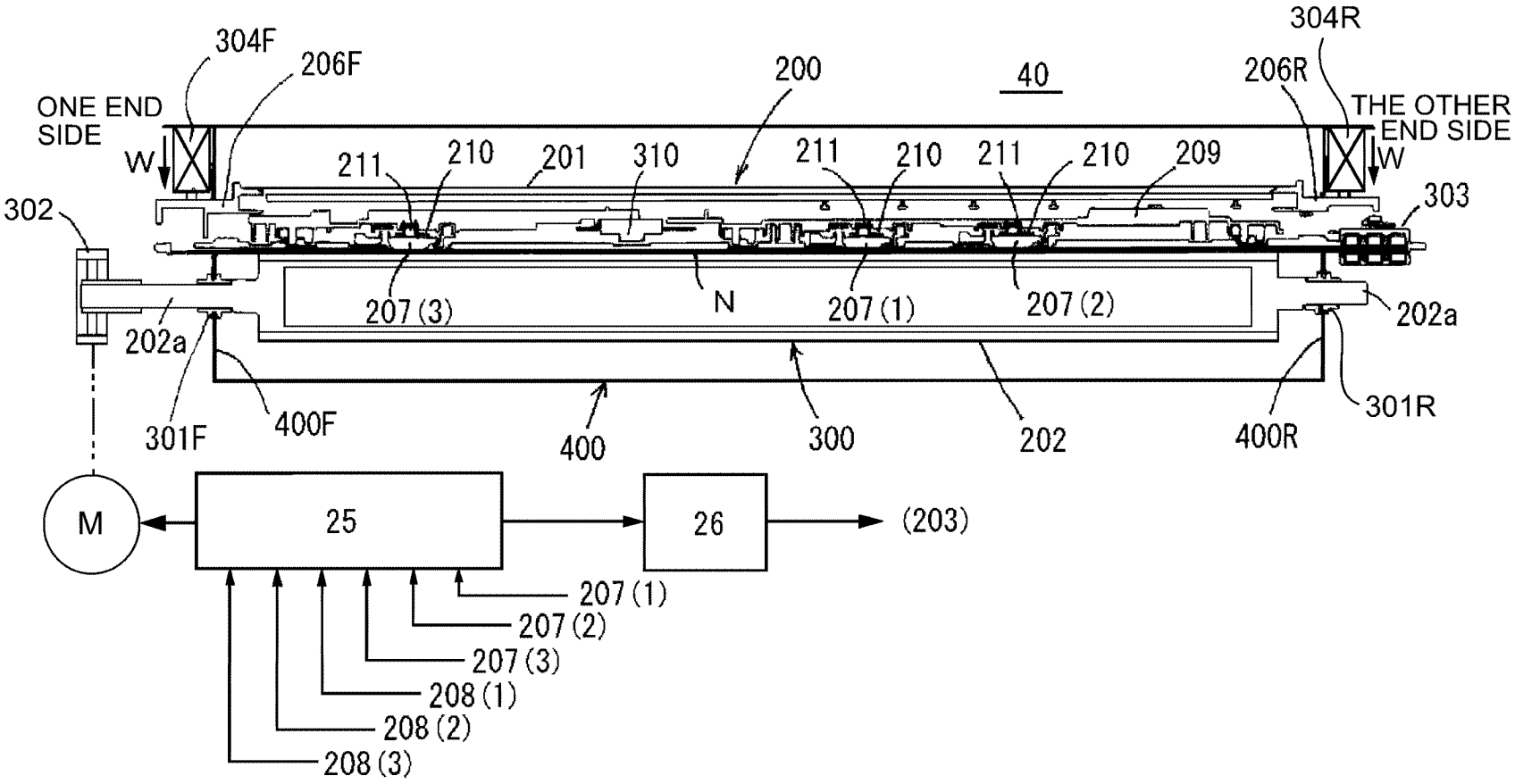
FIG. 4 is a schematic sectional view of the fixing device taken along (4)-(4) of FIG. 3.

FIG. 3 is an enlarged cross-sectional view (schematic view) of a principal part of the fixing device 40, and FIG. 4 is a sectional view (schematic view) of the fixing device taken along (4)-(4) line of FIG. 3. This fixing device 40 is an on-demand fixing device (OMF fixing device) of a belt (film) heating type and a pressing member driving type. A basic structure and a fixing operation of the fixing device 40 are well known and, therefore, will be briefly described.

The fixing device 40 is roughly includes the following three units:

(2-1) a belt unit (film unit) 200 as a heating member, (2-2) a pressing roller unit 300 as a pressing member for forming a nip (fixing nip) N in cooperation with the belt unit 200, and (2-3) a device main assembly (frame unit) 400 accommodating these units 200 and 300 as assembled with each other.

The nip N is a portion in which the recording material P, carrying the unfixed toner images t thereon, is nipped and fed and the toner images t are fixed by heat and pressure. Part (a) of FIG. 5 is a perspective view of an outer appearance of the belt unit 200, and part (b) of FIG. 5 is a perspective view of an outer appearance of the pressing roller unit 300.

(2-1) Belt Unit 200

The belt unit 200 is an assembly of an endless fixing belt (hollow rotatable heating member) 201, a ceramic heater (heating member) 203, a heater holder 204, a metal stay 205, flange members 206(F, R), a thermistor holder 209, and the like. The thermistor holder 209 is a supporting member for supporting, as temperature detecting means, a heater thermistor 207, a belt thermistor 208, and a thermo switch 310, and supporting DC lines (lead wires, or bundle wire) 330 of the heater thermistor 207 and the belt thermistor 208, and the like.

(2-1-1) Fixing Belt

The fixing belt (first rotatable member, or hollow rotatable member) 201 is a heat conductive member for conducting heat to the recording material P and is a flexible heat-resistant member having a substantially cylindrical shape in a free state. In this embodiment, the belt 201 is a composite layer belt prepared by coating a perfluoroalkoxy alkane (PFA) tube on an outer peripheral surface of a belt base material formed of a heat-resistant polyamideimide material having an inner diameter of 24 mm and a thickness of 50 μm. The belt 201 can also be formed in the form of a metal sleeve.

(2-1-2) Ceramic Heater

The ceramic heater 203 is an elongated plate-like member extending along a width direction (longitudinal direction) of the belt 201, and is a low thermal capacitance heater increasing in temperature with a characteristic such that a temperature of the heater 203 abruptly rises as a whole by energization. A specific structure of the heater 203 is omitted from illustration, but has a basic structure including an elongated thin plate-like ceramic substrate and an energization heat generating resistor layer provided on a surface of the substrate and extending along the surface of the substrate in a longitudinal direction.

(2-1-3) Heater Holder

The heater holder 204 is a member for fixedly supporting the heater 203 and has a substantially semicircular trough shape in cross section, and is an elongated member extending along the width direction of the belt 201. The heater 203 is engaged in a groove hole formed on an outer surface of the holder 204 along a longitudinal direction of the holder 204, and is bonded to the holder 204 with a heat-resistant adhesive.

The holder 204 is used for realizing a back-up of the heater 203 on the belt 201, pressing of the belt 201 at the nip N formed by the press-contact of the belt 201 with an elastic pressing roller 202 of the pressing roller unit 300, and feeding stability of the belt 201 during rotation. The holder 204 is required to have a sliding property, a heat-resistant property, a heat-insulating property, and an electrically insulating property, and, in this embodiment, a liquid crystal polymer resin material is used as a material for the holder 204.

The heater 203 and the holder 204 are members for causing the belt 201 to press-contact the elastic pressing roller 202 of the pressing roller unit 300 and thus from the nip N having a predetermined width with respect to a recording material feeding direction M, and the holder 204 slides on an inner peripheral surface of the belt 201. Therefore, the member including the heater 203 and the holder 204 in combination is referred to as a nip forming member 221.

(2-1-4) Metal Stay

The stay 205 is provided inside (on a side opposite to the heater side) of the holder 204 and is a rigid reinforcing member that backs up the holder 204 and that is long in the width direction of the belt 201. As a material of the stay 205, a 2.3 mm-thick zinc-electroplated steel plate molded in a "U"-character shape in cross section is used, so that strength is ensured. The stay 205 is pressed toward the pressing roller 202 side from a side that is opposite to a heater opposing surface side of the holder 204 formed of the liquid crystal polymer material, so that the heater 203 and the holder 204 are pressed towards the nip N, i.e., the nip forming member 221 is provided with strength and thus, a pressing force (pressure) at the nip N is ensured.

On the stay 205, flange members (fixing flanges) 206 (F, R), described later, and provided on one end side and the other end side, i.e., the flange members 206 (F, R) are mounted at longitudinal end portions, and ensure strength of the belt unit 200.

(2-1-5) Thermistor and Thermistor Holder

In a space defined by the holder 204 and the stay 205, the thermistor holder 209 is provided. The thermistor holder 209 is an electrically insulating mold member formed of a heat-resistant resin material and is a long member extending along the longitudinal direction of the holder 204.

FIG. 6 is a perspective view of the thermistor holder 209 on which the heater thermistor 207, the belt thermistor 208, the thermo switch 310, the DC line 330, and the like, are assembled and supported, as seen from a side opposite to the heater side. FIG. 7 is a perspective view of the thermistor holder 209 as seen from the heater side (a side opposing the back surface of the heater 203). Incidentally, in FIGS. 6 and 7, an AC connector 303 mounted on the other end side of the belt unit 200 is also illustrated together with the thermistor holder 209.

The thermistor holder 209 is provided, at a plurality of positions (three positions in this embodiment) along the longitudinal direction thereof, with heater thermistors 207(1), 207(2), and 207(3) for detecting and controlling the temperature of the heater 203. Further, the thermistor holder 209 is provided, at a plurality of positions (three positions in this embodiment) along the longitudinal direction thereof, with belt thermistors 208(1), 208(2), and 208(3) for detecting the temperature of the belt 201. Further, on the thermistor holder 209, the thermo switch 310 is mounted.

Referring to FIGS. 4 and 7, the three heater thermistors 207(1), 207(2), and 207(3) are fixed to spring holders 210 and are pressed by pressing springs 211 from the thermistor holder side. In a state in which the thermistor holder 209 is assembled with the holder 204, the respective heater thermistors 207 are maintained in a state of being pressed to the back surface of the heater 203 with a pressing force of 2.45 N (0.25 kgf) by a spring force of the pressing springs 211.

FIG. 8 is an enlarged perspective view (schematic view) showing a structure of the belt thermistor 208. A temperature detecting portion 208*a* of the belt thermistor 208 is covered with an insulating sheet 208*b* and is mounted on a free end side of a flexible leaf spring portion (metal portion) 208*c*. Referring to FIGS. 3, 7 and 8, each of the belt thermistors 208(1), 208(2), and 208(3) is directly fixed at a fixed end 208*d* to the thermistor holder 209. Specifically, the fixed end 208*d* of the belt thermistor 208 is fixed to the thermistor holder 209 by a toothed stopper ring 401.

Further, in a state in which the nip forming member 211, the thermistor holder 209 and the stay 205 are assembled into a unit, each of the belt thermistors 208 is projected toward an outside of the holder 204 through a cut-away hole 205*a* (FIG. 3) formed in the stay 205 (FIG. 9).

In a state of the belt unit 200, each belt thermistor 208 elastically contacts the inner surface of the belt 201 at the temperature detecting portion 208*a* thereof by bending elasticity (spring elasticity). As a result, the temperature detecting portion 208*a* can follow the inner surface of the belt 201 corresponding to the rotation (movement) of the belt 201 and is kept in a contact state with the belt inner surface of the belt 201. That is, as shown in FIG. 3, the belt thermistor 208 is mounted in the belt 201 so that the temperature detecting portion 208*a* thereof clings to the inner surface of the belt 201.

Electrical devices, such as the belt thermistors 207 and the heater thermistors 208, are required to transmit information, such as the temperature of the heater 203 to the controller 205, and, therefore, are provided with the DC lines 330. These DC lines 330 are extended through cut-away portions 209*b* to 209*i* (FIG. 7) provided on the thermistor holder 209 and are connected with a groove of the thermistor holder 209 provided on a side opposite to the thermistors.

The thermo switch 310 is connected in series to an alternating current (AC) line 320 for energizing the heater 203, and, in a case in which the temperature of the belt 201 abnormally increases, the thermo switch 310 operates when the thermo switch 310 detects an abnormal temperature of the belt 201 and thus stops (shuts off) supply of electrical power (energization) to the heater 203.

The thermo switch 310 is locked to the thermistor holder 209 by being hooked on a projected portion 209*a* (FIG. 7) provided on the thermistor holder 209. Specifically, the thermo switch 310 is partly inserted into the projected portion 209*a* projected from the thermistor holder 209, and the AC line 320 is assembled so as to extend around the thermistor holder 209 to reach an opposite side of the thermistor holder 209, as shown in FIG. 7. As a result, the thermo switch 310 is mounted on the thermistor holder 209 by stiffness of the AC line 320.

(2-1-6) Flange Member

The belt 201 incorporates, as an inside member, an assembly of the above-described members 203 to 205 and 207 to 209, and is externally engaged with (fitted around) the inside member loosely. In this embodiment, the belt 201 has an inner peripheral length of 102% of an outer peripheral length of the inside member and thus, is somewhat loosely engaged with (fitted around) the inside member. Longitudinal end portions of the nip forming member 221 and the stay 205 are projected outwardly through associated openings of longitudinal end portions of the belt 201 in a predetermined manner. Further, on the projected portions on one end side and the other end side, the flange members 206F and 206R provided on one end side (front side) and the other end side (rear side), respectively, are mounted (engaged).

The flange members 206F and 206R are regulating (preventing) members for regulating (preventing) longitudinal movement and a circumferential shape of the belt 201, and, as a material thereof, a liquid crystal polymer resin material having a heat-resistant property and a sliding property in combination. Each of the flange members 206F and 206R includes, as shown in FIGS. 3 to 5, a flange portion (flange seat portion) 206*a*, a belt guide portion 206*b* positioned inside the flange portion 206*a*, and a portion-to-be-pressed 206*c* positioned outside the flange portion 206*a*.

The belt 201 is positioned between the opposing flange portions 206*a* and 206*a* of the flange members 206F and 206R provided on one end side and the other end side, respectively. The flange portion 206*a* is a portion for preventing movement of the belt 201 in a thrust direction by receiving an end portion edge surface of the belt 201. The belt guide portion 206*b* is a portion for maintaining the cylindrical shape of the belt 201 (i.e., for stabilizing a rotational locus of the belt 201) by supporting the inner peripheral surface of the belt 201 at the longitudinal end portion from the inside of the belt 201. The portion-to-be-pressed 206*c* is a portion for receiving a pressing force W from a pressing mechanism 304(F, R) (FIG. 4).

FIG. 9 shows an example of an assembling method of the belt 201. First, the nip forming member 221 (203+204), the thermistor holder 209 prepared by assembling the heater thermistors 207, the belt thermistors 208, the thermo switch 310, and the like, into a unit in a predetermined manner, and the stay 205 are combined in a predetermined manner, so that the inside member of the belt 201 is assembled. On one of end portions (the other end side in this embodiment) of the inside member, the flange member 206R is mounted. A resultant assembly is referred to as a belt unit structure 212.

The belt 201 is externally fitted around the belt unit structure 212 from one end side (an end portion opposite to the flange member 206R side). In this case, the respective belt thermistors 208(1), 208(2), and 208(3) pass through the cut-away holes 205*a* (FIG. 3) of the stay 205 and project to an outside of the holder 204. Therefore, the belt 201 is moved so that the respective belt thermistors 208 are positioned inside the belt 201 while the leaf spring portions 208*c* thereof are elastically deformed.

After the belt 201 is sufficiently moved until a leading end thereof with respect to a belt movement direction is received by the flange portion (flange seat portion) 206*a* of the flange member 206R, the flange member 206F is mounted on the belt unit structure 212 on one end side. As a result, the belt unit structure 212 is assembled with the belt 201 and the flange member 206F.

The thus assembled belt unit 200 including the belt 201 is regulated (prevented) at one end surface and the other end surface thereof by the flange portions 206*a* of the flange members 206F and 206R on one end side and the other end side, respectively. As a result, a longitudinal position of the belt 201 is regulated. Further, the inner surface of the belt 201 is supported by the nip forming member 221 (203+204) and the belt guiding portions 206*b* of the flange members 206F and 206R on one end side and the other end side, respectively. As a result, a radial position of the belt 201 is regulated.

(2-2) Pressing Roller Unit

The pressing roller unit 300 includes the elastic pressing roller (second rotatable member) 202. The pressing roller 202 is constituted by a metal core 202*a* consisting of a mild steel, an elastic material layer 202*b* of a silicone rubber coated and molded concentrically integral with an outer peripheral surface of the metal core 202*a*, and a parting layer 202*c*, which is a surface layer formed with a PFA tube. The pressing roller 202 has an outer diameter of 30 mm. The pressing roller 202 is rotatably supported by side plates 400F and 400R of a casing 400 through bearing 301F and 301R on one end side and the other end side, respectively.

The belt unit 200 is disposed substantially in parallel to the pressing roller 202 so that the heater 203 faces an upper surface (side) of the pressing roller 202. The flange members 206F and 206R an one end side and the other end side are engaged with and held by engaging portions of the side plates 400F and 400R of the casing 400 on one end side and the other end side, respectively, so as to be slidable (movable) in an up-down direction. On the portions-to-be-pressed 206*c* of the flange members 206F and 206R on one end side and the other end side, downward loads W of 157 N (16 kgf on one side) in this embodiment are exerted by the pressing mechanisms 304F and 304R, respectively.

By the loads W, the stay 205 and the holder 204 are pressed down, so that the belt 201 is press-contacted to the pressing roller 202 against elasticity of the elastic material layer 202*b*, with a total pressing force (pressure) of 314 N (32 kgf) by the heater 203 and a part of the holder 204, which constitute the nip forming member 221. As a result, between the belt 201 and the pressing roller 202, the nip N having a predetermined width is formed with respect to the recording material feeding direction M.

(2-3) Fixing Operation

A driving force of a motor (driving means) M controlled by the controller 25 is transmitted to a gear 302 mounted on the metal core 202*a* of the pressing roller 202 on one end side. As a result the pressing roller 202 is rotationally driven as a driving rotatable member at a predetermined peripheral speed in the counterclockwise direction of an arrow R202 in FIG. 3. By the rotational drive of the pressing roller 202, the belt 201 of the belt unit 200 is rotated in the clockwise direction of an arrow R201 in FIG. 3, while the inner surface thereof slides on and in intimate contact with the heater 203 and a part of the holder 204 which constitute the nip forming member 221 at the nip N.

The fixing belt 201 slides on the heater 203 and the part of the holder 204, whereby a sliding resistance thereof generates. Onto a belt sliding portion of the nip forming member 221, fluorine-containing grease (lubricant) having a heat-resistant property is applied so that a value of the sliding resistance is not excessively high and is a certain value. The pressing roller 202 overcomes the sliding resistance and rotates, and thus feeds (conveys) the recording material P to be guided to the nip N.

The heater 203 is supplied with electrical power from an energizing portion (electrical power supplying portion) 26, controlled by the controller 25, through the AC connector 303 mounted on the holder 204 holding the heater 203, on the other end side. The energizing portion 26 and the AC connector 303 are electrically connected with each other by the AC line (lead wire) 320. By this energization, the heater 203 generates heat and increases in temperature with an abrupt rising characteristic.

The temperature of the heater 203 is detected by the heater thermistors 207(1), 207(2), and 207(3) disposed at three predetermined positions of the thermistor holder 209 along the longitudinal direction of the thermistor holder 209. Further, the temperature of the belt 201 is detected by the belt thermistors 208(1), 208(2), and 208(3) disposed at three predetermined positions of the thermistor holder 209 along the longitudinal direction of the thermistor holder 209. Pieces of detection temperature information of these thermistors are fed back to the controller 25 via the DC lines 330. On the basis of the detection temperature information fed back to the controller 25, the controller 25 controls electrical power supplied from the energizing portion 26 to the heater 203 so that the temperatures of the heater 203 and the belt 201 are predetermined temperatures depending on a size and thickness of the recording material P introduced into the fixing device 40.

This recording material P fed from the image forming portion 2 to the fixing device 40, while carrying the unfixed toner image t thereon, is guided by an entrance guide 214 and enters the nip N, and is then nipped and fed in the nip N. As a result, heating and pressing of the recording material P are simultaneously carried out in the nip N, so that the toner image t is fixed as a fixed image on the recording material P. The recording material P passed through the nip N is separated from the belt 201 by curvature separation and is discharged to an outside of the fixing device 40. A separating plate 213 is provided at a predetermined position downstream of the nip N with respect to the recording material feeding direction M, so that the recording material P can be smoothly separated from the belt 201.

(2-4) Feature Structure (2-4-1) Plastic Deformation Prevention of Belt Thermistor As described above with reference to FIG. 9, in a state in which the nip forming member 211, the thermistor holder 209, and the stay 205 are assembled into a unit, the respective thermistors 208 project to the outside of the holder 204 through the cut-away holes 205*a* (FIG. 3) formed in the stay 205. Accordingly, when the belt 201 is externally fitted around and assembled with the belt unit structure 212, the belt 201 is moved while the leaf spring portions 208*c* of the belt thermistors 208 are disposed inside the belt 201 by being elastically deformed.

An elastically deformed region a of the belt thermistors 208 is shown in FIG. 10. When the belt 201 is assembled with the belt unit structure 212, the leaf spring portions 208*c* of the belt thermistors 208 and required to be elastically deformed at least from a non-load state 208-1 indicated by a chain line of FIG. 10, to a deformed state 208-2 indicated by a solid line of FIG. 10.

In the case of the belt thermistors 208 used in this embodiment, a deformation amount is required to satisfy $\alpha \leq 30°$. When $\alpha \geq 30°$ is satisfied, the leaf spring portion 208*c* of each of the belt toners 208 is plastically deformed, so that it is concerned that normal temperature detection cannot be carried out.

Therefore, in order to satisfy $\alpha \leq 30°$, the thermistor holder 209 is provided with a back-up portion (interposed portion) 209*x*. As a result, a maximum deformation position of the belt thermistor 208 is a position in which the belt thermistor 208 abuts against the back-up portion 209*x*, and thus, a condition of $\alpha \leq 30°$ is maintained, so that plastic deformation of the leaf spring portion 208*c* of the belt thermistor 208 is suppressed.

(2-4-2) Insulating Structure

An insulating condition in the belt 201 will be described with reference to FIG. 11. Basic insulation of a heater surface 203*h* of the heater 203, which is regarded as a primary circuit, is carried out by a glass coat 203. As security measures against a case in which the basic insulation is broken, however, it is desirable to add additional insulation in addition to the basic insulation. For example, in a case in which the DC line and the metal portion (secondary circuit) connecting with the DC line 330 cannot sufficiently ensure spatial and creepage distances with the heater 203 (primary circuit), it is concerned that a current supplied to the heater 203 increases. As a result, there is a liability that an overcurrent flows through the controller 25 via the leaf spring portion 208*c*. In the condition in this embodiment, in order to provide the additional insulation, it is desired that the creepage distance, from the heater surface 203*h* to the DC line 330, or the metal portion to which the DC line 330 is connected, of 2.5 mm or more, is ensured.

In this embodiment, the following conditions a to c are set:

a: The metal portion is regarded as having a distance of 0 mm. In this embodiment, the belt 201 and the stay 205 correspond to the metal, b: The creepage distance of 1.0 mm or less is regarded as being 0 mm, and c: The spatial distance is regarded as the creepage distance by being multiplied by 1.25.

In consideration of the above conditions a to c, when the insulating condition in this embodiment is adduced, the following patterns I to IV are required to be 2.5 mm or more.

Pattern I: (creepage distance A)+(spatial distance B×1.25)+(spatial distance C×1.25), Pattern II: (creepage distance A)+(spatial distance B×1.25)+(spatial distance D×1.25)+(creepage distance E), Pattern III: (creepage distance A)+(creepage distance F)+(spatial distance D×1.25)+(creepage distance E), and Pattern IV: (creepage distance A)+(creepage distance F)+(spatial distance C×1.25).

(2-4-3) Insulating Effect of Belt Thermistor

Figure 1:
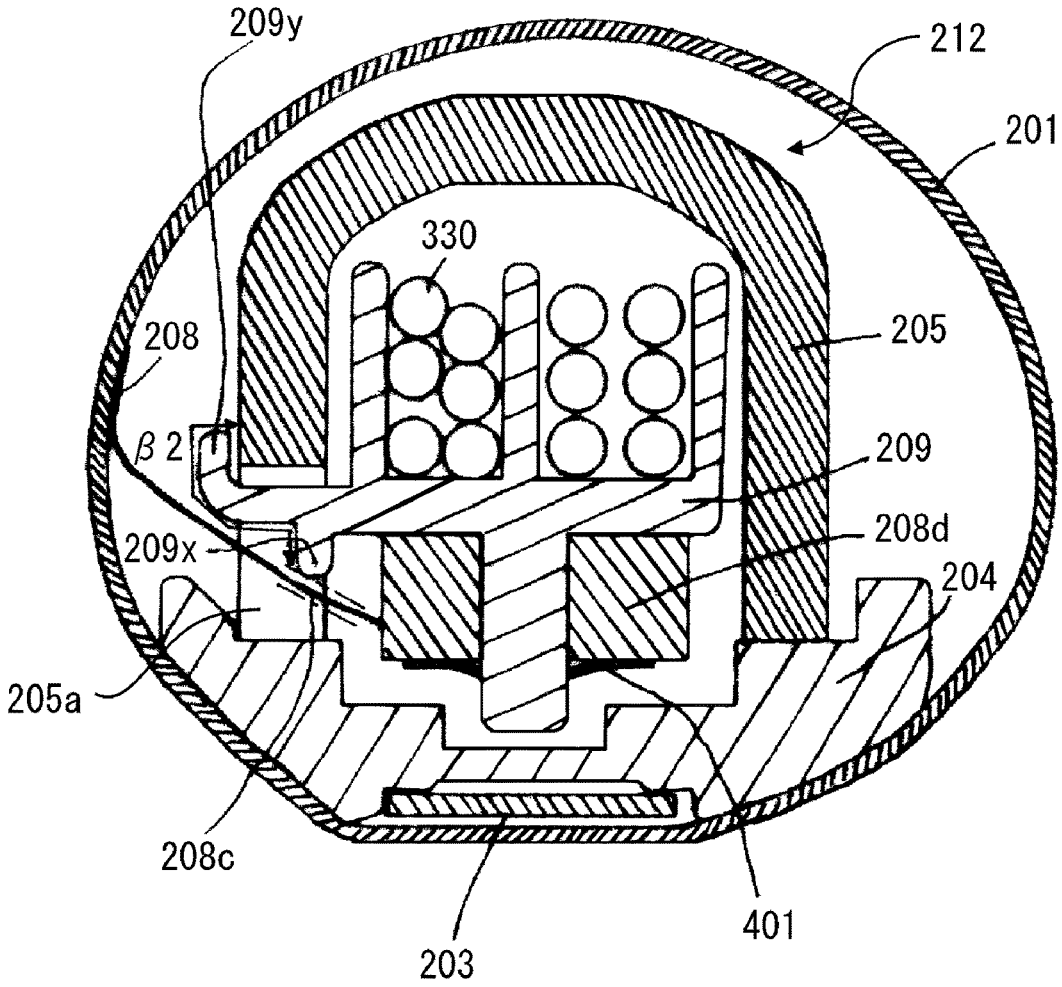
FIG. 1 is an enlarged schematic cross-sectional view of a principal part of a belt unit of a fixing device in an embodiment.

FIG. 12 shows an insulating structure of the belt thermistor 208 in a case in which a feature structure of the belt unit described with reference to FIG. 1 is not provided. The belt thermistor 208 includes a metal-exposed portion (a portion (range), of the leaf spring portion 208*c* that is not covered with the insulating sheet 208*b*) as shown in FIG. 8. For that reason, there is a need to consider the above-described additional insulation. In that case, as shown in FIG. 12, it is required that a distance β1 between the cut-away hole 205*a* of the stay 205 and the leaf spring portion 208*c* of the belt thermistor 208, of 2.5 mm or more, is ensured.

In order to ensure the distance β1, there is a need to provide a large cut-away hole 205*a* of the stay 205. In a case in which the large cut-away portion is provided, however, a deformation (flexure) amount of the stay when the stay 205 is pressed by the pressing mechanisms 304F and 304R increases, so that it becomes difficult to uniformly press the holder 204 along the longitudinal direction. Further, it is concerned that the deformation amount of the stay 205 increased and thus, the stay 205 is plastically deformed.

FIG. 1 shows an insulating structure of the belt thermistor 208 in a case in which the feature structure in this embodiment is provided. That is, the thermistor holder 209 is provided with an extended portion (interposed portion) 209*y*. As a result, a creepage distance from the leaf spring portion (metal-exposed portion) 208*c* of the belt thermistor 208 to the cut-away hole 205*a* of the stay 205 is β2, so that the creepage distance of 2.5 mm or more, which is sufficient to realize the additional insulation, can be easily provided.

The feature structure of the fixing device (image heating apparatus) 40 in this embodiment is summarized as follows.

The fixing device (image heating apparatus) 40 for heating the toner image t on the recording material P while nipping and feeding the recording material P through the nip N includes the belt (hollow rotatable heating member) 201, the nip forming member 221 disposed so as to slide on the inner peripheral surface of the belt 201, and the pressing roller (pressing member) 202, which opposes the nip forming member 221 through the belt 201 and which forms the nip N in cooperation with the belt 201. Further, the fixing device 40 includes the metal stay 205 pressing the nip forming member 221 on the inside of the belt 201.

The fixing device 40 further includes the belt thermistor (temperature detecting means) 208 for detecting the temperature of the belt 201 in elastic contact with the inner surface of the belt 201 by spring elasticity of the metal portion 208*c* of the belt thermistor 208. The fixing device 40 includes the electrically insulating thermistor holder (supporting member) 209, provided inside the belt 201, for supporting the belt thermistor 208. The thermistor holder 209 includes the interposed portions 209*x* (back-up portion) and 209*y* (extended portion) positioned between the metal stay 205 and at least a part of the metal portion of the belt thermistor 208.

When the metal portion 208*c* is bent against elasticity thereof, bending of the metal portion 208*c* is prevented by abutment against the interposed portions 209*x* and 209*y*. The interposed portions 209*x* and 209*y* increase the creepage distance (32 from the metal portion 208*c* to the metal stay 205 compared with a case in which the interposed portions 209*x* and 209*y* are not provided.

Further, effects of the fixing device (image heating apparatus) 40 are summarized as follows.

Insulating Effect

The interposed portions 209*x* and 209*y* are positioned between the metal portion (secondary circuit) 208*c* of the belt thermistor 208 and the heater 203 or the metal component part (primary circuit) close to the heater 203. As a result, an abnormally large current is prevented from generating by ensuring the creepage distance between the metal portion 208*c* of the belt thermistor 208 and the heater 203 or the metal component part close to the heater 203.

Assembling Property Improving Effect

For example, in a case in which an insulating sheet is applied onto the metal stay 205 or the metal portion 208*c* of the belt thermistor 208, the insulating sheet is applied onto a complicated shape portion or a minute portion, so that an operation during assembling is complicated. On the other hand, in the fixing device 40 of this embodiment, the interposed portions 209*x* and 209*y* are provided on the thermistor holder 209, and, therefore, an application operation can be reduced. Further, the thermistor holder 209 is integrally molded as the mold member, so that a mounting operation of the interposed portions 209*x* and 209*y* on the thermistor holder 209 can be omitted, so that an assembling property is further improved.

Further, when the belt 201 is externally fitted around the belt unit structure in order to avoid contact between the belt end portion and the belt thermistor holder 208, the interposed portions 209*x* and 209*x* of the supporting member 209 back up the belt thermistor 208 in a case in which the belt 201 is externally fitted while elastically deforming the belt thermistor 208 is employed. For that reason, the belt thermistor 208 is prevented from excessively deforming and breaking.

OTHER EMBODIMENTS (1) The present invention is not limited to the embodiments described above, but the embodiments can be appropriately changed to other embodiments within a scope of a technical concept of the present invention. Further, the numbers, positions, shapes, and the like, of constituent members (portions) are not limited to those in the above-described embodiments, but can be changed to those suitable for carrying out the present invention.

(2) A heating means for heating the belt 201, as the rotatable heating member, is not limited to the ceramic heater 203 used in the above-described embodiments. For example, a heating constitution in which the belt 201 is internally or externally heated using a halogen heater or electromagnetic induction heating coil can also be employed.

(3) The pressing roller 202, as the pressing member, can also be changed to the form of a rotatable endless belt member.

(4) The image heating apparatus of the present invention is not limited to the fixing device as in the above-described embodiments in which the unfixed toner images t carried on the recording material P are heat-fixed as a fixed image under application of heat and pressure. The image heating apparatus is also effective as a heat treating apparatus for adjusting a surface property of an image in such a manner that an image (fixed image or partly fixed image), which is once fixed or temporarily fixed on the recording material P, is improved in glossiness by being heated and pressed.

(5) The image forming portion of the image forming apparatus is not limited to the image forming portion of the electrophotographic type. Image forming portions of an electrostatic recording type and of a magnetic recording type may also be used. The transfer type is not limited to the intermediary transfer type, but a direct transfer type in which the unfixed toner image is directly transferred onto the recording material P may also be used.

(6) The fixing device (image heating apparatus) 40 is not limited to the fixing device fixed inside the image forming apparatus, but may also be assembled into a unit detachably and replaceably mountable to the image forming apparatus. In this case, the unit may be a type in which the unit, including the controller 25, is demounted and exchanged, and may also be a type in which the unit, excluding the controller 25, is demounted and exchanged. Further, the fixing device may also be used singly dependently of the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A belt unit for forming a heating nip in cooperation with an opposing rotatable member, said belt unit comprising:

an endless belt including a metal layer;

a nip forming member having a heater that includes a heat generating element generating heat by energization and configured to heat said endless belt while being in contact with an inner peripheral surface of said endless belt, said nip forming member being configured to sandwich said endless belt in cooperation with said rotatable member so as to form the heating nip;

a metal stay configured to press said nip forming member toward said rotatable member;

a temperature detecting element configured to detect a temperature of said endless belt;

a metal leaf spring configured to urge said temperature detecting element, configured to detect the temperature of said endless belt, toward the inner peripheral surface of said endless belt;

an insulating supporting member positioned inside said stay and configured to support said leaf spring;

a cord configured to electrically connect with said temperature detecting element through said leaf spring; and an insulating holder portion including an interposed portion interposed between an exposed portion of said leaf spring and said stay, so as to provide insulation therebetween, and being configured to hold said supporting member, wherein a creepage distance from said heat generating element to the exposed portion of said leaf spring, through said stay and said interposed portion, is 2.5 mm or more.

2. The belt unit according to claim 1, wherein said holder portion is a holder holding said cord, configured to electrically connect with said temperature detecting element through said leaf spring.

3. The belt unit according to claim 1, wherein said heater includes an insulating layer configured to insulate said heat generating element.

4. The belt unit according to claim 1, wherein said cord, configured to electrically connect with said temperature detecting element through said leaf spring, electrically connects said temperature detecting element with a controller through said leaf spring.

5. The belt unit according to claim 1, further comprising a temperature detecting element configured to detect a temperature of said heater, wherein said holder portion is a holder holding a spring for urging said temperature detecting element, configured to detect the temperature of said heater, toward said heater.

6. The belt unit according to claim 5, further comprising a cord electrically connecting said temperature detecting element configured to detect the temperature of said heater, and a controller, wherein said holder portion is a holder holding said cord electrically connecting said temperature detecting element, configured to detect the temperature of said heater, and the controller.

7. The belt unit according to claim 1, wherein said holder portion and said interposed portion are integrally molded with a resin material.

8. A belt unit for forming a heating nip in cooperation with an opposing rotatable member, said belt unit comprising:

an endless belt including a metal layer;

a nip forming member having a heater that includes a heat generating element generating heat by energization and configured to heat said endless belt while being in contact with an inner peripheral surface of said endless belt, said nip forming member being configured to sandwich said endless belt in cooperation with said rotatable member so as to form the heating nip;

a metal stay configured to press said nip forming member toward said rotatable member;

a temperature detecting element configured to detect a temperature of said endless belt;

a metal leaf spring configured to urge said temperature detecting element, configured to detect the temperature of said endless belt, toward the inner peripheral surface of said endless belt;

an insulating supporting member positioned inside said stay and configured to support said leaf spring;

a cord configured to electrically connect with said temperature detecting element through said leaf spring; and an insulating holder portion including an interposed portion interposed between an exposed portion of said leaf spring and said stay, so as to provide insulation therebetween, and being configured to hold said supporting member, wherein, when said leaf spring is bent against elasticity thereof, bending of said leaf spring is prevented by contact of the exposed portion of the leaf spring with said interposed portion.

9. An image heating apparatus comprising:

an endless belt including a metal layer;

a rotatable member configured to form a heating nip, in which a toner image on a sheet is heated, in cooperation with said endless belt;

a nip forming member having a heater that includes a heat generating element generating heat by energization and configured to heat said endless belt while being in contact with an inner peripheral surface of said endless belt, said nip forming member being configured to sandwich said endless belt in cooperation with said rotatable member so as to form the heating nip;

a metal stay configured to press said nip forming member toward said rotatable member;

a temperature detecting element configured to detect a temperature of said endless belt;

a metal leaf spring configured to urge said temperature detecting element, configured to detect the temperature of said endless belt, toward the inner peripheral surface of said endless belt;

an insulating supporting member positioned inside said stay and configured to support said leaf spring;

a cord configured to electrically connect with said temperature detecting element through said leaf spring; and an insulating holder portion including an interposed portion interposed between an exposed portion of said leaf spring and said stay, so as to provide insulation therebetween, and being configured to hold said supporting member, wherein a creepage distance from said heat generating element to the exposed portion of said leaf spring through said stay and said interposed portion is 2.5 mm or more.

10. The image heating apparatus according to claim 9, wherein said holder portion is a holder holding said cord, configured to electrically connect with said temperature detecting element through said leaf spring.

11. The image heating apparatus according to claim 9, wherein said heater includes an insulating layer configured to insulate said heat generating element.

12. The image heating apparatus according to claim 9, wherein said cord, configured to electrically connect with said temperature detecting element through said leaf spring, electrically connects said temperature detecting element with a controller through said leaf spring.

13. The image heating apparatus according to claim 9, further comprising a temperature detecting element configured to detect a temperature of said heater, wherein said holder portion is a holder holding a spring for urging said temperature detecting element, configured to detect the temperature of said heater, toward said heater.

14. The image heating apparatus according to claim 13, further comprising a cord electrically connecting said temperature detecting element, configured to detect the temperature of said heater, and a controller, wherein said holder portion is a holder holding the second cord said cord electrically connecting said temperature detecting element, configured to detect the temperature of said heater, and the controller.

15. The image heating apparatus according to claim 9, wherein said holder portion and said interposed portion are integrally molded with a resin material.

16. An image heating apparatus comprising:

an endless belt including a metal layer;

a rotatable member configured to form a heating nip, in which a toner image on a sheet is heated, in cooperation with said endless belt;

a nip forming member having a heater that includes a heat generating element generating heat by energization and configured to heat said endless belt while being in contact with an inner peripheral surface of said endless belt, said nip forming member being configured to sandwich said endless belt in cooperation with said rotatable member so as to form the heating nip;

a metal stay configured to press said nip forming member toward said rotatable member;

a temperature detecting element configured to detect a temperature of said endless belt;

a metal leaf spring configured to urge said temperature detecting element, configured to detect the temperature of said endless belt, toward the inner peripheral surface of said endless belt;

an insulating supporting member positioned inside said stay and configured to support said leaf spring;

a cord configured to electrically connect with said temperature detecting element through said leaf spring; and an insulating holder portion including an interposed portion interposed between an exposed portion of said leaf spring and said stay, so as to provide insulation therebetween, and being configured to hold said supporting member, wherein, when said leaf spring is bent against elasticity thereof, bending of said leaf spring is prevented by contact of the exposed portion of the leaf spring with said interposed portion.

* * * * *